US011554465B2

(12) United States Patent
Buchanan

(10) Patent No.: US 11,554,465 B2
(45) Date of Patent: Jan. 17, 2023

(54) LOCKING PARALLEL PLIERS

(71) Applicant: Nigel Buchanan, Fife (GB)

(72) Inventor: Nigel Buchanan, Fife (GB)

( * ) Notice: Subject to any disclaimer, the term of this patent is extended or adjusted under 35 U.S.C. 154(b) by 54 days.

(21) Appl. No.: 16/630,101

(22) PCT Filed: Jul. 10, 2018

(86) PCT No.: PCT/GB2018/051962

§ 371 (c)(1),
(2) Date: Jan. 10, 2020

(87) PCT Pub. No.: WO2019/012273

PCT Pub. Date: Jan. 17, 2019

(65) Prior Publication Data

US 2021/0146505 A1 May 20, 2021

(30) Foreign Application Priority Data

Jul. 10, 2017 (GB) ..... 1711100
Oct. 30, 2017 (GB) ..... 1717861

(51) Int. Cl.
*B25B 7/12* (2006.01)

(52) U.S. Cl.
CPC ..... *B25B 7/123* (2013.01)

(58) Field of Classification Search
CPC ..... B25B 7/123
USPC ..... 81/368, 346, 336–338, 357–359
See application file for complete search history.

(56) References Cited

U.S. PATENT DOCUMENTS 2,112,873 A * 4/1938 Wright ..... B25B 7/12 81/343
5,609,080 A * 3/1997 Flavigny ..... B25B 7/123 81/368
6,748,829 B2 * 6/2004 Seber ..... B25B 7/123 81/368
9,010,222 B2 * 4/2015 Peirce ..... B25B 7/10 81/319

FOREIGN PATENT DOCUMENTS

FR 2713124 A1 * 6/1995 ..... B25B 7/10

* cited by examiner

*Primary Examiner* — Hadi Shakeri
(74) *Attorney, Agent, or Firm* — Patterson Intellectual Property Law, P.C.; Emily A. Shouse

(57) ABSTRACT

Pliers (1) comprising jaw (201, 301) portions incorporating gripping faces for the clamping of the desired workpiece (90), three pivotal handle (202) portions and a sprung toothed strut (60) positioned between the handles (202). A bow shaped resilient portion (408) or portions, incorporated within the third arm (200, 300, 400) portion, when the pliers are operated this resilient portion imparts a sprung pressure upon the clamped workpiece (90) by the gripping face (203, 303) of the jaws (201, 301). The third arm (200, 300, 400) and bend promoting portion are contiguous with each other. The jaws (201, 301) can further be usefully locked in the required clamping position upon the workpiece (90) by a toothed sprung strut (60) pivotally attached to the first and third arms (200) and conveniently being locked or unlocked according to the locking switch (500, 50) pivotal within the first arm (200, 300, 400).

10 Claims, 6 Drawing Sheets

501
508
500
502
505
503
63
64

201
200
1
80
90
301
207
60
300

402
81
65
407
400
208
412
403
400

508
500
509
511
509
505
64
G
91
500
G
212
306
307
408
402
208

403
404
81
407
A
65
60
C
202
300
206
405
401
C

LOCKING PARALLEL PLIERS

FIELD OF INVENTION

The invention relates to hand operated gripping tools, gripping tools that are adjustable within the range of the jaws of the tool. One form of hand operated gripping tool of the locking type generally referred to as locking pliers which are colloquially known as vice grip pliers.

BACKGROUND TO THE INVENTION

Existing "vice grip" pliers have the common characteristic of jaws initially adjusted by a screw on the end of the fixed handle, the closure of the moving handle operating an over-cam mechanism to lock the jaws upon the workpiece, the prior adjustment of the screw determining the locking pressure of the said jaws upon the workpiece, several adjustments usually being required to attain the required gripping pressure.

Further types of pliers are adapted to slideably close upon a workpiece in response to manual closing of the handles and, in response to contact with the workpiece, automatically lock against further sliding action by engaging suitable teeth and thereby shift from a sliding to a pivoting mode whereby continued exertion of manual force on the handles increases the gripping action upon the workpiece.

Existing locking pliers such as those shown in US2015/283681 (Wu) and US2015/273664 (Skodje et al) comprise of two robust handles connected to two robust jaws, and a locking mechanism connected to the two jaws. The handles can be squeezed too close the jaws. The locking member is attached to an over centre linkage which when utilized prevents the lower handle from pivoting from its closed configuration and until opened retaining the jaws in a closed position. The clamping width of the jaws being adjusted by an adjustment screw, the adjustment screw further determining the clamping pressure exerted upon the clamped workpiece. As the clamping pressure requires to be preordained, it can take several attempts to correctly adjust the screw to the required position in order to clamp the workpiece the best way. The clamping width of the jaws once set by the adjusting screw is finite, any movement, vibration or relaxing of the clamped material normally resulting in the failure of the clamping action, this is most prevalent when the device is used to initially clamp bodywork parts during the panel beating process prior to welding or bolting the panels being worked on, inadvertent over pressure applied by the clamping jaws usually resulting in the damage or distortion of the clamped parts.

U.S. Pat. No. D742194 (Engel) shows a set of pliers having a toothed strut with a locking mechanism attached to one operating arm, as the arms are closed the teeth "ratchet" past the lock, as the operating arms are not designed to resiliently deform during robust operation, the toothed arc of the strut remains in substantially the same locking angle relative to the locking mechanism.

U.S. Pat. No. 9,272,394 (Buchanan) discloses pliers or clamps having a single bow or arcuate portion to permit limited flexing of one of the handles. A pivotal strut retained between the handles, the strut slidably held in a channel within one handle and pivotally held within the other handle. The pivotal end of the strut having a toothed arc, which acts with a further switched pawl, to lock or unlock the handle positions relative to one another. The compression of the handles in the first instance closing the gap between the fixed and moveable jaws, the moveable jaw sliding up a clamp bar portion until the jaws robustly contact the workpiece, the further operation of the handles resulting in the clamping of the workpiece, the resilient arcuate portion acting to impose a limited sprung grip upon the workpiece, further usefulness imported by the locking action of the pawl teeth within the strut arc teeth when the pawl is switched into its ratchet locking position retaining the handles substantially in their closed position providing a limited spring grip upon the workpiece. These pliers although efficient are expensive and complex to manufacture.

The closure of the prior art devices when operated upon workpieces at or near to their maximum size operating limit require the handles to be operated at a width above the span of normal or small hands, therefore requiring the use of two hands, at least initially.

The closing force of the prior art devices is largely governed by the length of the handles compared to their jaw opening requiring handles of a reasonable length which can restrict their use in certain areas.

It is an object of the invention to at least partially alleviate the above-mentioned disadvantages, or to provide an alternative to existing products. Embodiments of the invention may provide a more cost effective product, capable of more than one function.

SUMMARY OF THE INVENTION

According to the invention there is provided pliers comprising jaw portions incorporating gripping faces within the opposing jaws for the clamping of the desired workpiece, pivotal handle portions which are capable of operation by most small hands. Bow shaped resilient portion or portions are usefully incorporated within either or both the jaw or one of the handle portions, when the pliers are operated these resilient portions impart a useful superior sprung pressure upon the clamped workpiece by the gripping face of the jaws. The bend promoting portion is contiguous with the pivotal third handle and enhanced leverage portion. The jaws can further be usefully locked in the required clamping position upon the workpiece by a toothed sprung strut pivotally attached to the first handle and conveniently being locked or unlocked according to the locking switch pivotal within the fixed or first handle.

The pliers may incorporate clamping widths within its specification that are automatically adjusted, the locking pressure can be further usefully determined by the operator by the straightforward gripping pressure of the handles, the simple release of the handles initiating the locking if required of the jaws upon the clamped parts.

The may comprise an intuitive switch locking/unlocking mechanism utilizing less parts than previous pliers type tools comprising pivotal struts with toothed arcs interacting with a switch. The switch usefully now directly incorporates a locking, ratcheting or disengaged teeth mechanism according to its chosen orientation, which can be usefully utilized as required to engage with the teeth of the toothed strut arc to positionally to lock as required the same, thereby locking the clamped workpiece within the jaw portions, or alternately disengaging the switch teeth from the strut toothed arc releasing the workpiece from the jaws, according to the pivotal switch orientation.

An embodiment of the invention may provide pliers comprising a switch incorporating a ratchet function, the switch incorporating a bore for the engagement of a positional pin and its compression spring, the positional pin being free to move lengthwise within the bore against the resilient force of the spring. In best practice the outer end of the positional pin is rounded or angled with a smooth blunt point for ease of movement against a corresponding peaked engagement profile. The pin having a close sliding fit within the bore whereas it can easily traverse inwards or outwards against the spring within the bore according to the engagement between the blunt point and the corresponding peaked engagement profile mounted within the handle. The said switch engagement profile further comprising of a transition peak with a sloping open profile on one side and a switch closing profile on the other, the pivotal switch can be manually intuitively operated by the operator from either chosen position, during the switch positional operation the positional pin is propelled into the switch bore against the incumbent spring as its outward blunt point moves against the corresponding upwardly sloping engagement profile till it traverses the peak of the engagement profile and consequently now engages the downwardly sloping engagement profile at the other side of the peak, the switch spring usefully resiliently propelling the positional pin blunt outward end against its corresponding sloping engagement profile positively resiliently engaging or disengaging the switch teeth from the toothed strut arc teeth according to the operators requirements.

As it is commercially prudent to have a ratchet like clicking noise to accompany the jaw closure and locking procedure the interaction of the resiliently biased switch teeth with the corresponding pivotal strut toothed arc teeth, when the switch is in the closing position provides a typical ratchet like sound as the strut rotates during the closure procedure around the strut axle against the resilience of the strut spring.

The pliers may comprise a switch incorporating a cost effective ratchet function, the switch incorporating a bore for the engagement of a positional pin and its compression spring, the positional pin being free to move lengthwise within the bore against the resilient force of the spring. In best practice the outer end of the positional pin is rounded or angled with a blunt point for ease of movement against a corresponding peaked engagement profile. The pin having a close sliding fit within the bore whereas it can easily traverse inwards or outwards against the spring within the bore according to the engagement between the blunt point and the corresponding peaked engagement profile mounted within the handle. The said switch engagement profile further comprising of a transition peak with a sloping open profile on one side and a switch closing profile on the other, the pivotal switch can be manually intuitively operated by the operator from either chosen position, during the switch positional operation the positional pin is propelled into the switch bore against the incumbent spring as its outward blunt point moves against the corresponding upwardly sloping engagement profile till it traverses the peak of the engagement profile and consequently now engages the downwardly sloping engagement profile at the other side of the peak, the switch spring usefully resiliently propelling the positional pin blunt outward end against its corresponding sloping engagement profile positively resiliently engaging or disengaging the switch teeth from the toothed strut arc teeth according to the operators requirements.

As it is commercially prudent to have a ratchet like clicking noise to accompany the jaw closure and locking procedure the interaction of the resiliently biased switch teeth with the corresponding pivotal strut toothed arc teeth, when the switch is in the closed position provides a typical ratchet like sound as the strut rotates during the closure procedure around the strut axle against the resilience of the strut spring.

The pliers clamping widths within its specification are automatically adjusted, the locking pressure can be further be usefully determined by the operator by the straightforward gripping pressure of the handles, the simple release of the handles initiating the locking of the jaws upon the clamped parts. The utilization of a bowed resilient portion within the third locking handle providing superior constant jaw clamping pressure of the part or parts clamped whilst normally preventing surface damage to the parts clamped. The present invention further works on a reasonable range of workpiece sizes and shapes whilst optionally utilizing superior sprung gripping force of the workpiece. Furthermore, the main parts are capable of being stamped or made by high pressure moulding HPM or metal injection moulding MIM in order to further reduce their cost.

Another embodiment may comprise a third handle which is pivotally attached to the second handle with a strong extension spring resilient portion between the said handles propelling the third handle open from the second handle. The first jaw element is attached to the first arm and the corresponding second jaw element attached to the second arm, the first and second arms are pivotally connected by a pivot pin at their distal ends a further extension spring resilient portion attached between the first and second handles propels the first and second arms open relative to one another when the handles are deactivated, the second arm spring and its pivotal leverage are chosen to be of a lesser value than that of the third to second handle spring in order that the first to second handle closure can be initiated whilst the movement of that of the third to second handle is substantially resisted by the superior strength of the second handle to third handle spring. The hand grip squeezing of the operator is made upon the first and third handle lever grips initially against the resilience of the strut spring or third arm spring until the jaws initially close, gripping the workpiece to be operated within the jaws. The second arm movement now inhibited by the gripped workpiece causes the third arm to further pivot around its pivot pin against the resilience of the associated spring between the said handles as gripping force is further applied whereas the third arm cam rotates until the substantially first smooth cam arc portion transmutes to a second appropriately toothed cam arc portion which now usefully engages upon the correspondingly toothed first arm bar slidingly held within a channel within the second arm. The third arm as it is further squeezed rotates around its pivot pin robustly closing the moving jaw upon the workpiece as the toothed cam acts upon the bar toothed profile. The operator simply chooses the level of jaw grip required by the amount of applied grip pressure applied between the first and third arms.

The pliers may have an enhanced jaw closure only after the jaws have first gripped the workpiece. As the third arm requires little movement in relation to the second arm during the initial closure sequence which can be variable in relation to the size of the actual workpiece operated, the major third arm pivotal movement is still available for the second sequence, the enhanced jaw closure. The enhanced jaw closure is directly equivalent to the ratio of the length from the pivot pin of the third arm levering portion to that of the third arm toothed cam levered portion distance from the said pivot pin which acts as the fulcrum, even using shorter than standard handle lengths a closure force ratio of 10 to 1 or better is attainable compared to a standard 5 to 1 with long handles.

Another embodiment may provide functional pliers with substantially smaller handle grip initial openings to allow ease of use even by small hands.

Another embodiment provides pliers with substantially shorter handle portions to allow ease of use in restricted areas.

Another embodiment provides pliers comprising a first arm having opposing ends, a first end of the first arm forming a first handle pivotally connected to the second arm at its outer end, a second end of the first arm comprising a jaw element, the first arm further comprises a bar incorporating a toothed profile at the base of the jaw element, the said planar bar having a smooth contact surface and a toothed contact surface; a second arm having opposing ends, the second arm pivotally connected to the first arm at its outer end by a pivot pin; a second jaw element integral within the second arm, the internal base of the said second jaw element is in the form of a slot for the passage of the first arm toothed bar, the internal jaw base contact surface is smooth with external radiuses for the smooth generally parallel movement of the toothed bar as required within the slot; the third arm is pivotally connected to the second arm by a pivot pin, the third arm comprises a levering or handle end portion and a levered end portion or third arm cam portion, the third arm cam comprising a smooth cam portion and a toothed cam portion, the smooth cam portion in the first instance smoothly acts against the opposing teeth of the toothed bar attached to the first arm, the tolerances chosen ensure ease of passage of the toothed bar within the formed second jaw slot yet retaining acceptable generally parallel movement of the opposing jaws.

Another embodiment provides pliers comprising of a first, second and third arm, the first arm comprising a jaw element, the handle element comprising a recess containing a switch which can be engaged or disengaged upon the teeth of the strut toothed cam by the operation of the said switch, the strut resiliently biased by in one example a strong extension spring attached to the strut toothed cam and at its distal end attached to the first handle, the strut having an outer cam which acts against the third arm strut cam channel profile and retained within the strut channel pin slot by a strut cam pin, the pivot pins through the switch, strut toothed cam and outer cam can also be usefully incorporated within the said pivotal parts. When the switch is in the deactivated position the strut is resiliently biased by the extension spring attached to the strut toothed cam, urging the third arm handle portion outwards from the first and second arm as the strut outer cam is propelled up against the third arm strut cam channel profile and retained within the strut cam pin slot, the third arm toothed cam portion is automatically disengaged from the first arm bar toothed profile as the third arm pivots outwards, the second arm is further propelled around its outer end pivot fully opening the first and second jaw elements relative to one another. The resilient propulsion required can be further supplemented or re-allocated to other positions within the pliers, for example between a second arm spring lever incorporated within the distal end of the second arm and a mount on the first arm, this spring propels the first and second arm into the open position. A further example of a spring position being between a third arm sprung lever portion and a mount within the second arm, this resilient portion urges the third arm out from the second arm.

Another embodiment provides pliers comprising of plier jaws held closed under a useful resilient gripping tension during the locking or non-locking pliers operation. The pliers third arm incorporating an arc or bowed section which has a width from about 5% to 80% thinner than the rest of the third arm. In best practice the arced portion is situated between the third arm cam and the handle end gripping portion and constructed from suitable spring steel material, the profile, material and thickness of the produced clamp resilient portion or living spring is carefully chosen in order to provide a repeatable resilience with little chance of stress cracking during repeated use. The resilient portion is in the form of a slow curve or arc in the direction of the third handle closure force. The third handle can be further usefully locked in the chosen jaw elements clamping pressure position, the pivotal strut is rotatable around its axle pin when the first and third handles are clenched closing the jaw elements upon the workpiece etc. As the said handles are further activated the third handle pivots around its pivot pin and the strut outer cam slides down against the third arm cam channel profile further guided within the third handle strut cam pin slot by the strut outer cam having a retention pin or pin like protrusions fitted for this purpose. When the pivotal switch is operated into the closed position, the strut toothed cam teeth can usefully "ratchet" over the corresponding teeth on the pivotal switch, according to the pressure applied to the said handles. When the operator has reached the level of clamping required and releases the applied grip of the said handles, the ratchet teeth of the pivotal switch and the corresponding teeth of the strut toothed cam engage in a locking manner. The flex induced within the bowed portion or living spring and the enduring clamping of the jaw elements upon the clamped parts is retained by the angle of the locked strut and the retention pin within the strut outer cams further engagement within the strut cam pin slot wherein the tension or elastic potential energy within the bowed third arm portion is therefore retained for the purposes of placing the jaws under useful resilient gripping tension. If the clamped parts were subjected to movement or vibration which would defeat the fixed clamping effect of prior art vice grip pliers the present device would still retain its grip albeit a lesser one, the clamping action of the jaws being further determined by the remaining resilience of the bowed portion, the elastic potential energy. The resultant jaw resilient closing force is largely proportional to the force applied to the first and third handles and the pivotal dimension ratio between the third handle levering portion and the levered third handle cam, upon the first handle bar toothed profile, less any small losses incurred during the switch locking procedure.

Another embodiment provides pliers apparatus whereas the teeth profiles used by the toothed pawl, strut toothed cam, third arm toothed cam portion and first arm bar toothed profile are in the best example saw tooth like in profile in that the locking faces of the teeth used are over upright and need to relieved of locking tension by squeezing the handle grips before the switch can be deactivated or released, this further acts as an efficient safety lock feature.

Another embodiment provides pliers apparatus whereas, although the composition could consist of mainly cast or forged parts for example, for cost effectiveness the construction shown comprises a semi-laminate like assembly capable of being stamped from flat metal plate, furthermore the switch and toothed parts are capable of being stamped or HPM (high pressure moulded) or metal injection moulded MIM in order to further reduce their manufacturing cost.

REFERENCE TO THE DRAWINGS

For the ready reference of the reader the reference numerals used in the drawings have been tabulated in ascending numerical order.

| | |
|---|---|
| 1 | Locking Parallel Pliers |
| 200 | First Arm |
| 201 | First Jaw Element |
| 202 | First Arm Handle |
| 203 | First Jaw Gripping Face |
| 204 | Assembly Holes |
| 205 | Pivot Pin Hole |
| 206 | First Handle Grip |
| 207 | First Arm Bar |
| 208 | First Arm Bar Toothed Profile |
| 209 | First Arm Spacer |
| 210 | First Arm Outer Plates |
| 211 | First Arm Bar End Stop |
| 212 | First Arm Bar Smooth Profile |
| 300 | Second Arm |
| 301 | Second Arm Jaw Element |
| 302 | Second Arm Outer End Pivot |
| 303 | Second Jaw Gripping Face |
| 304 | Assembly Holes |
| 305 | Pivot Pin Hole |
| 306 | Second Jaw Internal Contact Surface |
| 307 | Second Jaw Slot |
| 308 | Second Arm Outer Plates |
| 309 | Second Arm Spring Lever Hole |
| 310 | Second Arm Spring Lever |
| U | Switch Unlocked Position |
| L | Switch Locking Position |
| C | Clenching Force |
| G | Gripping Force |
| R | Ratcheting Function |
| A | Triangular Elastic Potential Energy Structure |
| 400 | Third Arm |
| 401 | Third Arm Levering Portion |
| 402 | Third Arm Levered Portion |
| 403 | Third Arm Smooth Cam Portion |
| 404 | Third Arm Toothed Cam Portion |
| 405 | Third Arm Grip |
| 406 | Strut Cam Channel Profile |
| 407 | Strut Cam Pin Slot |
| 408 | Third Arm Resilient Portion |
| 409 | Third Arm Outer Plates |
| 410 | Third Arm Assembly Holes |
| 411 | Third Arm Pivot Hole |
| 412 | Third Arm Spring Hole |
| 413 | Third Arm Sprung Lever Portion |
| 500 | Pivotal Switch |
| 501 | Pivotal Switch Actuator |
| 502 | Switch Biasing Block |
| 503 | Switch Teeth |
| 504 | Biasing Pin Bore |
| 505 | Biasing Pin |
| 506 | Biasing Pin Actuating End |
| 507 | Biasing Pin Spring Abutment End |
| 508 | Switch Pivotal Axle |
| 509 | Biasing Block Closing Profile |
| 510 | Biasing Block Transition Peak |
| 511 | Biasing Block Opening Profile |
| 60 | Strut |
| 61 | Strut Distal End Cam |
| 62 | Strut Pivot Pin |
| 63 | Strut Toothed Cam |
| 64 | Strut toothed Cam Teeth |
| 65 | Strut Distal End Cam Retention Pin |
| 70 | Strut Spring |
| 71 | Switch Spring |
| 72 | Second Arm Spring |
| 73 | Third Arm Spring |
| 80 | First to Second Arm Pivot Pin |
| 81 | Second to Third Arm Pivot Pin |
| 82 | Assembly Rivets |
| 83 | Spring End Pins |
| 84 | Third Arm Stop Pin |
| 90 | Workpiece |
| 91 | Clamped Metal Pieces |

REFERENCE TO THE DRAWINGS

Following is a listing of the various components used in the best mode preferred embodiment and alternative embodiments. For the ready reference of the reader the reference numerals have been arranged in ascending numerical order.

Locking parallel pliers 1 comprise:—of a first arm 200, first jaw element 201, first arm handle 202, first jaw gripping face 203, assembly holes 204, pivot pin hole 205, first handle grip 206, first arm bar 207, first arm bar toothed profile 208, first arm spacer 209, first arm outer plates 210, first arm bar end stop 211, first arm bar smooth profile 212, second arm 300, second arm jaw element 301, second arm outer end pivot 302, second jaw gripping face 303, assembly holes 304, pivot hole 305, second jaw internal contact surface 306, second jaw slot 307, second arm outer plates 308, second arm spring lever hole 309, second arm spring lever 310, third arm 400, third arm levering portion 401, third arm levered portion 402, third arm smooth cam portion 403, third arm toothed cam portion 404, third arm grip 405, strut cam channel profile 406, strut cam pin slot 407, third arm resilient portion 408, third arm outer plates 409, third arm assembly holes 410, third arm pivot hole 411, third arm spring hole 412, third arm sprung lever portion 413, pivotal switch 500, pivotal switch actuator 501, switch biasing block 502, switch teeth 503, biasing pin bore 504, biasing pin 505, biasing pin actuating end 506, biasing pin spring abutment end 507, switch pivotal axle 508, biasing block closing profile 509, biasing block transition peak 510, biasing block opening profile 511, strut 60, strut distal end cam 61, strut pivot pin 62, strut toothed cam 63, strut toothed cam teeth 64, strut distal end cam retention pin 65, strut spring 70, switch spring 71, second arm spring 72, third arm spring 73, first to second arm pivot pin 80, second to third arm pivot pin 81, assembly rivets 82, spring end pins 83, third arm stop pin, workpiece 90, clamped metal pieces 91, switch unlocked position U, switch locking position L, clenching force C, gripping force G, ratcheting function R, triangular elastic potential energy structure A.

BRIEF DESCRIPTION OF THE DRAWINGS

A full and enabling disclosure of the present Invention including the best mode thereof, directed to one of ordinary skill in the art, is set forth in the specification, which makes reference to the appended drawings, in which.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention that may be embodied in various forms. The figures are not necessarily to scale, some features may be exaggerated to show details of particular components. Therefore, specific structural and functional details disclosed herein are not to be interpreted as limiting, but merely as a basis for the claims and as a representative basis for teaching one skilled in the art to variously employ the invention.

Figure 1:
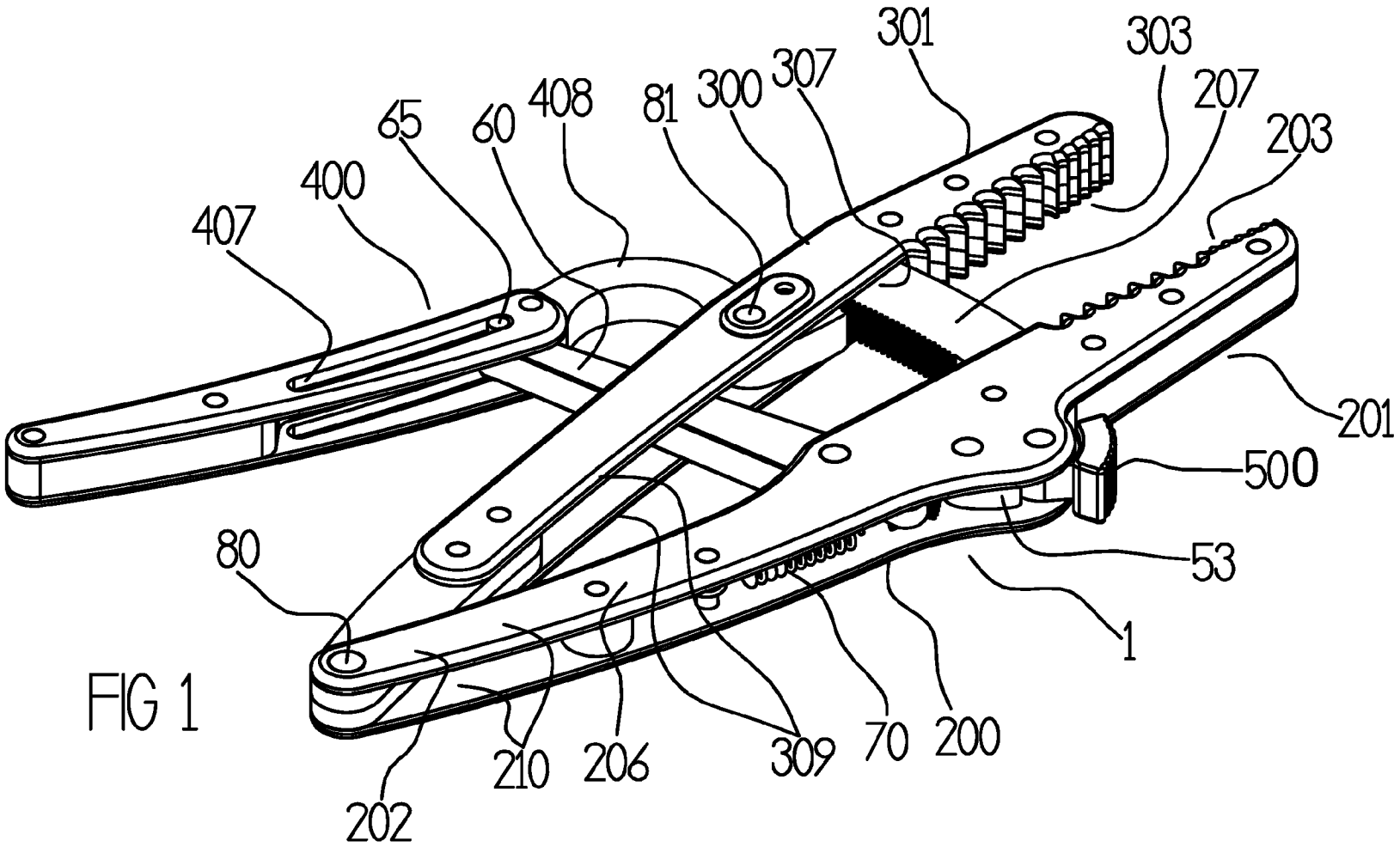
FIG. 1 is a perspective view of the Parallel Locking Pliers.

FIG. 1 illustrates an embodiment of a set of locking parallel pliers 1, the pliers 1 are at rest. Showing the first arm 200, the first jaw element 201 with its gripping face 203 contiguous with the first arm bar 207 and first handle grip 206. The pivotal switch 500, and strut 60 with its spring 70 located between the outer plates 210. The second arm 300 is pivotal to the first arm 200 around the pivot pin 80 within the first arm handle pivot 202. The second arm jaw element 301 with its gripping face 303 is contiguous within the second arm 300. The third arm 400 is pivotal around the pivot pin 81 and the strut 60 is further traversable within the gap 307 between the second arm outer plates 309. The third arm 400, further retains the strut distal end cam retention pin 65 within its pin slot 407, further displayed is the third arm resilient portion 408.

The first embodiment of the present invention 1 relates to a pliers apparatus comprising a switch 500 incorporating a ratchet function R, the switch 500 incorporating a bore 504 for the engagement of a biasing pin 505 and its compression spring 71, the biasing pin 505 being free to move lengthwise within the bore 504 against the resilient force of the spring 71. In best practice the outer end 506 of the positional pin 505 is rounded or angled with a smooth blunt point 506 for ease of movement against a corresponding peaked engagement profile 509, 510 and 511. The pin 505 having a close sliding fit within the bore 504 whereas it can easily traverse inwards or outwards against the spring 71 within the bore 504 according to the engagement between the blunt point 506 and the corresponding peaked 511 engagement profile mounted within the first handle 202. The said switch biasing block 502 engagement profile further comprising of a transition peak 510 with a sloping open profile 511 on one side and a switch closing profile 509 on the other, the pivotal switch 500 can be manually intuitively operated by the operator from either chosen position, during the switch 500 positional operation the positional pin 505 is propelled into the switch bore 504 against the incumbent spring 71 as its outward blunt point 506 moves against the corresponding upwardly sloping engagement profile 509, 511 till it traverses the peak of the engagement profile 510 and consequently now engages the downwardly sloping engagement profile 509, 511 at the other side of the peak 510, the switch spring 71 usefully resiliently propelling the positional pin 505 blunt outward end 506 against its corresponding sloping engagement profile 509, 511 positively resiliently engaging or disengaging the switch teeth 503 from the toothed strut cam teeth 64 according to the operators requirements.

As it is commercially prudent to have a ratchet like clicking noise to accompany the jaw 201, 301 closure and locking procedure the interaction of the resiliently biased switch teeth 503 with the corresponding pivotal strut toothed cam teeth 64, when the switch 500 is in the closing position L provides a typical ratchet R like sound as the strut 60 rotates during the closure procedure C around the strut pivot pin 62 against the resilience of the second arm spring 72 and or without the strut spring 70.

The present invention can even further incorporate a switch 500 incorporating a cost effective ratchet function R, the switch 500 incorporating a bore 504 for the engagement of a biasing pin 505 and its compression spring 71, the positional pin 505 being free to move lengthwise within the bore 504 against the resilient force of the spring 71. In best practice the outer end 506 of the positional pin 505 is rounded or angled with a blunt point 505 for ease of movement against a corresponding peaked 510 engagement profile 509, 511. The pin 505 having a close sliding fit within the bore 504 whereas it can easily traverse inwards or outwards against the spring 71 within the bore 504 according to the engagement between the blunt point 506 and the corresponding peaked 510 engagement profile 509, 510, 511 mounted within the first handle 202 handle. The said switch 500 biasing block 502 engagement profile 509, 510, 511 further comprising of a transition peak 510 with a sloping open profile 511 on one side and a switch closing profile 509 on the other. When the pivotal switch 500 is operated into the closed position L, the strut toothed cam teeth 404 can usefully "ratchet" R over the corresponding teeth 503 on the pivotal switch 500, according to the pressure applied C to the said handles 202, 405. When the operator has reached the level of clamping G required and releases the applied grip C of the said handles 202, 405 the ratchet teeth 503 of the pivotal switch 500 and the corresponding teeth 64 of the strut toothed cam 63 engage in a locking manner L.

Figures 2, 3, 4:
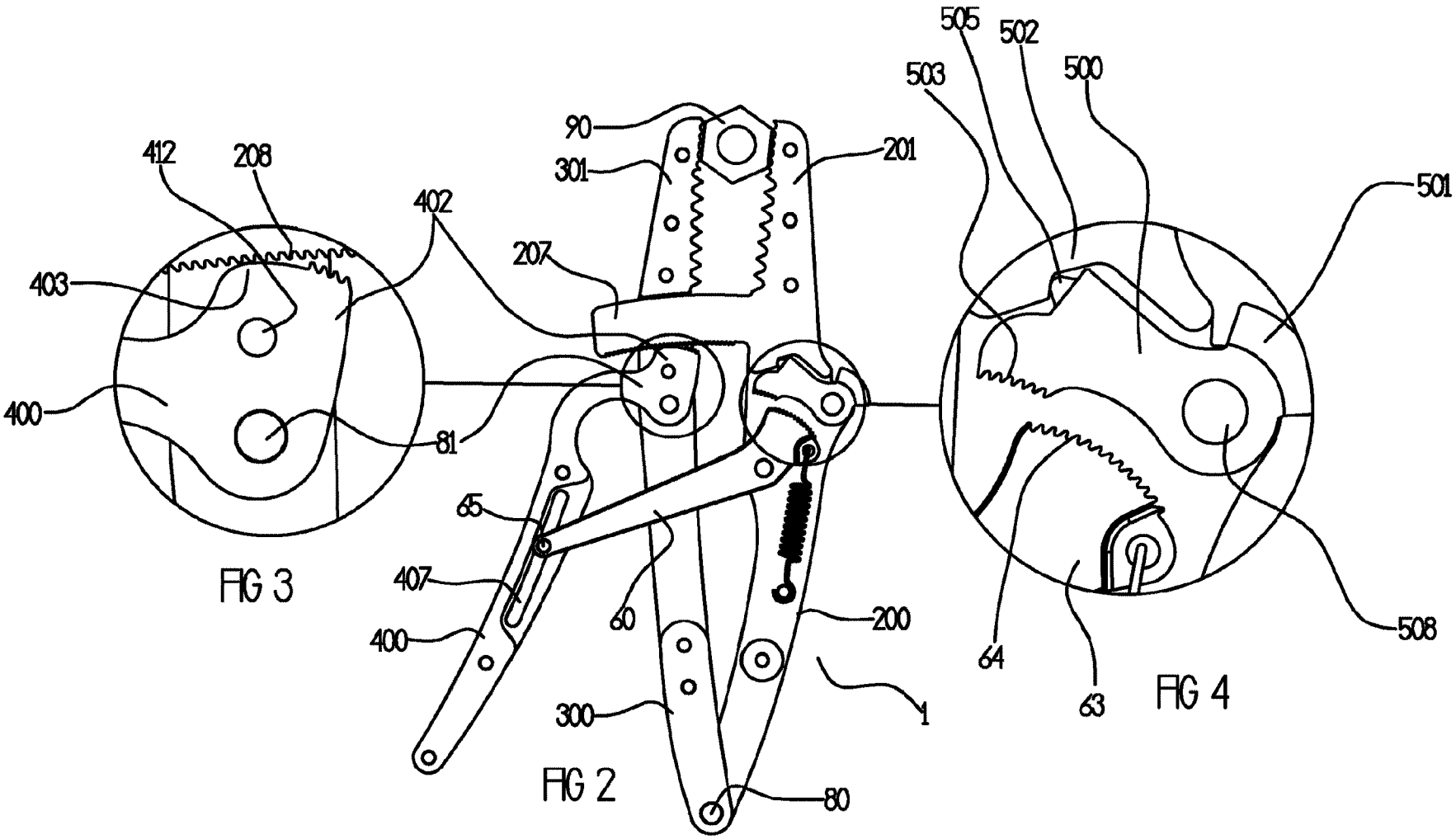
FIG. 2 is a plan view of the Parallel Locking Pliers first gripping on a workpiece. The first, second and third arm top plates/top laminates shown removed for illustration purposes.
FIG. 3 is a close up view of the third arm levered end portion, the third arm smooth cam portion abutting the first arm bar toothed profile.
FIG. 4 is a close up view of the pivotal switch in the open or unlocked position, the strut toothed cam teeth disengaged from the pawl locking teeth.

As it is commercially prudent to have a ratchet R like clicking noise to accompany the jaw 201, 301 closure G and locking L procedure the interaction of the resiliently biased switch 500 teeth 503 with the corresponding pivotal strut toothed arc teeth 64, when the switch 500 is in the closed position L provides a typical ratchet like sound as the strut 60 rotates during the closure G procedure around the strut pivot pin 62 against the resilience of the strut spring 70 when utilized FIG. 2 illustrates a further embodiment of a set of locking parallel pliers 1, the pliers 1 are shown first gripping a workpiece 90, the top plates 210, 309 (not shown) being removed for illustration purposes.

The further embodiment of the present invention is the utilization of a third arm 400 which is pivotally attached to the second arm 300. The first jaw element 201 is contiguous with the first arm 200 and the corresponding second jaw element 301 contiguous to the second arm 300, the first and second arms 200, 300 are pivotally connected by a pivot pin 80 at their distal ends. The hand grip squeezing of the operator is made upon the first and third handle lever grips 206, 405 initially in this example against the resilience of the first to second arm spring 72 until the jaws 201,301 as they close initially grip the workpiece 90 to be operated within the jaws 201,301. The strut 60 further pivots around its pivot pin 62 against the strong third arm spring 73 as the strut distal end retention pin 65 is driven down the third arm 400 strut cam pin slot 407 as the third arm 400 is operated to clamp the chosen workpiece 90.

FIG. 3 shows the third arm 400 levered end portion 402 with its smooth cam portion 403 abutting the first arm bar 207 toothed profile 208, the third arm 400 pivotal around the pivot pin 81.

FIG. 4 further illustrates the pivotal switch 500 for demonstration purposes shown in the disengaged position, its sprung actuator 51 at the appropriate end of the actuating profile 55 of the toothed pawl 53 which is pivotal around the pawl pivot 54, the strut cam toothed cam 63 teeth 64 free from the toothed pawl teeth 56.

Figures 5, 6, 7:
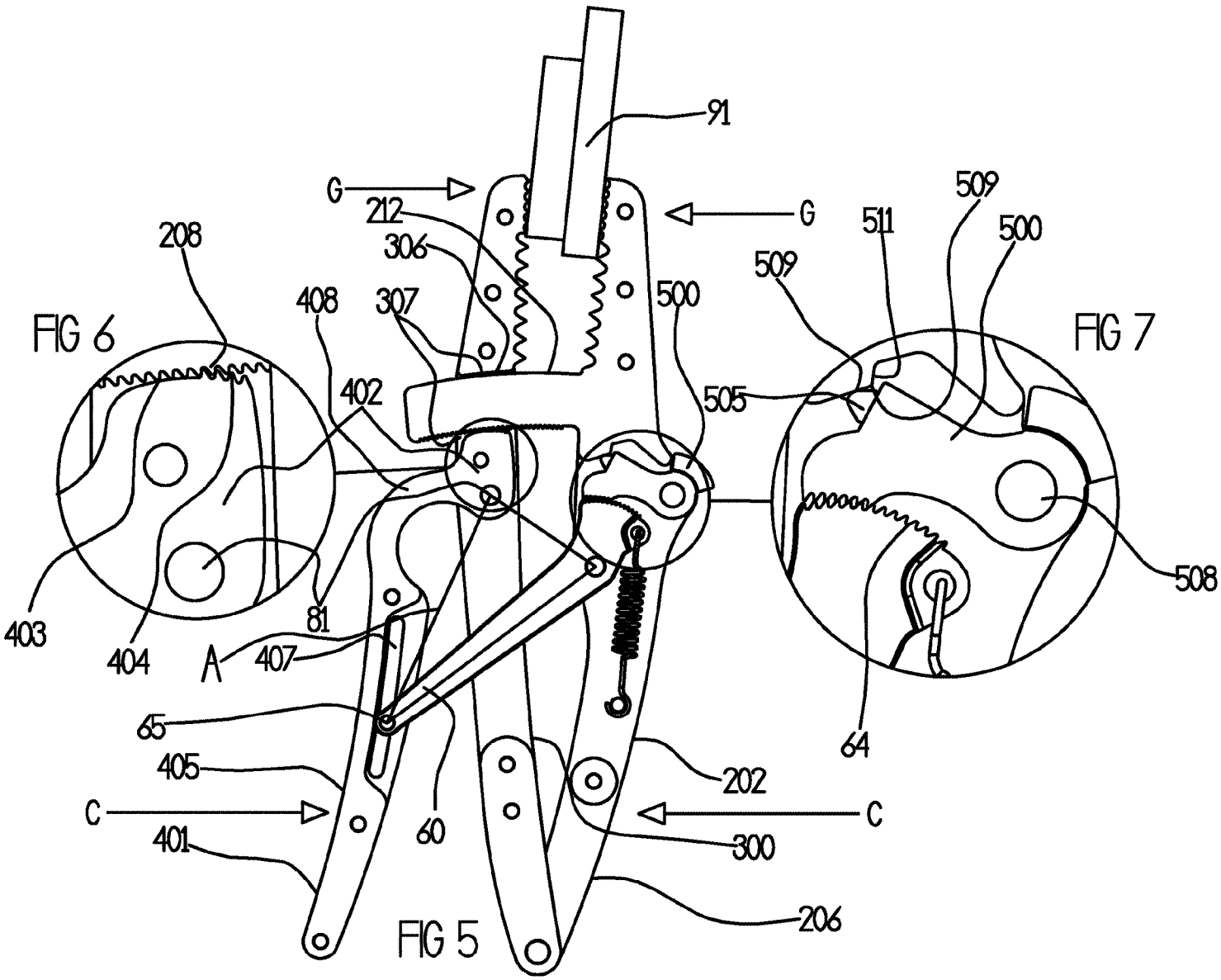
FIG. 5 is a plan view of the Parallel Locking Pliers robustly gripping on a workpiece. The first, second and third arm top plates/top laminates shown removed for illustration purposes.
FIG. 6 is a close up view of the third arm levered end portion, the third arm toothed cam portion engaging the first arm bar toothed profile.
FIG. 7 is a close up view of the pivotal switch in the closed or "ratcheting" position, the strut toothed cam teeth engaged into the pawl locking teeth.

As further illustrated in FIG. 5 the first and second 200,300 outer plates 210,309 (not shown) are removed for demonstration purposes. The second arm 300 movement now inhibited by the gripped G clamped metal workpieces 91 causes the third arm 400 to further pivot around its pivot pin 81 as clenching force C is further applied, whereas the third arm levered end portion 402 rotates until the substantially smooth cam arc portion 403 transmutes to a second appropriately saw toothed cam arc portion 404 which now usefully engages upon the correspondingly toothed 208 first arm bar 207 slidingly held within a channel or slot 307 within the second arm 300. The third arm 400 as it is further clenched C rotates around its pivot pin 81 robustly closing the first and second jaws 201,301 upon the chosen workpiece 90 as the toothed cam 404 acts upon the bar toothed profile 208. The operator simply choses the level of jaw 201,301 grip G upon the workpiece 90, 91 required by the amount of applied clenching pressure C applied between the first and third arms 200,300.

The present invention 1 can further incorporate clamping widths within its specification that are automatically adjusted, the locking pressure G can be further be usefully determined by the operator by the straightforward gripping pressure C of the said arm grips 206, 405 the simple release of the said grips 206,405 initiating the locking of the said jaws 201, 301 upon the said clamped parts 90, 91 when the switch 500 is in the locking position.

As illustrated in FIGS. 5 and 6 a further embodiment of the present invention is to provide enhanced jaw 201,301 closure only after the jaws 201,301 have first gripped the workpiece 90. As the third arm 400 requires little movement in relation to the second arm 300 during the initial closure sequence which can be variable in relation to the size of the actual workpiece 90,91 operated, the major third arm 400 pivotal movement is still available for the second sequence, the enhanced jaw 201, 301 closure. The enhanced jaw 201, 301 closure is directly equivalent to the ratio of the length from the pivot pin 81 of the third arm levering portion 401 to that of the third arm toothed cam levered portion 402 distance from the said pivot pin 81 which acts as the fulcrum, even using shorter than standard handle 202,401 lengths a closure force ratio of 10 to 1 or better is attainable compared to a standard 5 to 1 with regular long handles.

As illustrated in FIGS. 5 and 7 a further embodiment of the present invention is to provide a useful clamping device. There are a myriad of reasons for using such a device 1 from clamping and gripping in order to turn a fastener 90, especially a worn or damaged one to clamping two pieces of metal 91 together prior to welding them. The common failing in the prior art devices is if the clamped object or objects were to reduce their clamp width even slightly for whatever reason the solid grip imparted by these prior art devices would result in the failure of the devices ability to sustain further grip G upon the objects.

In order to overcome these failings, the present device 1 deliberately incorporates an extremely strong method of resiliently closing or further locking closed the tools 1 grip via its jaws 201, 301 of the worked objects 90, 91.

In one example, the resilient portion 408 is incorporated within the third arm 400 between the third arm levered portion 402 and the third arm levering portion 401. The profile, material and thickness of the said resilient portion 408 is carefully chosen in order to provide a repeatable resilience with the least chance of stress cracking during repeated use. The profile is in best practice a slow curve or arc 408 in the direction of the closing arm 400 force C. The flex induced within the living spring portion 408 and the gripping jaws 201, 301 upon the clamped parts 90, 91 is retained by the angle of the strut 60 and the strut distal end cam retention pin 65 within the third arm pin slot 407. The arc 408, strut 60 locked in position by its engagement with the toothed pawl 53 within the first arm 200 and the said first arms bar 207 engagement with the third arms toothed cam portion 404 forms a very robust frame placing the jaws 201, 301 under useful resilient gripping tension G. If the clamped parts 90, 91 were subjected to movement or vibration which would defeat the fixed clamping effect of prior art devices the present device 1 would still retain its grip G albeit a lessor one. The utilization of a said bowed resilient portion 408 within the third arm 400 providing superior constant said jaw 201, 301 clamping pressure of the said part or parts 90,91 clamped, whilst normally preventing surface damage to the said parts 90,91. The bowed said bend promoting portion or portions 408 exerting elastic potential energy to usefully spring clamp G, the said workpiece 90, 91 between the opposing jaws 201, 301. As even further illustrated in FIG. 5 the retained pivotal strut 60 thereby comprises a base of a triangular elastic potential energy structure A, the resilient portion 408 further comprising the side of the triangle A and the jaw pivot pin 81 as the apex, this formation usefully acts via the connected jaws 201, 301 to provide strong clamping pressure G to the said jaws 201, 301 upon the workpiece 90, 91 this clamping pressure G being advantageously resilient in nature.

The present invention further works on a reasonable range of said workpiece 90,91 sizes and shapes whilst utilizing superior said sprung gripping force G upon the said workpiece 90,91. FIG. 7. Illustrates the pivotal switch 500 locking teeth 503 engaged upon the strut toothed cam teeth 64. As the said teeth 503, 64 are saw like in profile the first arm grip 206 and the third arm grip 405 need to be clenched C to finally allow the release of the locking switch mechanism 500 teeth 56 and strut teeth 64 even if the switch 500 is de-operated, usefully providing a further safety lock.

Figure 8:
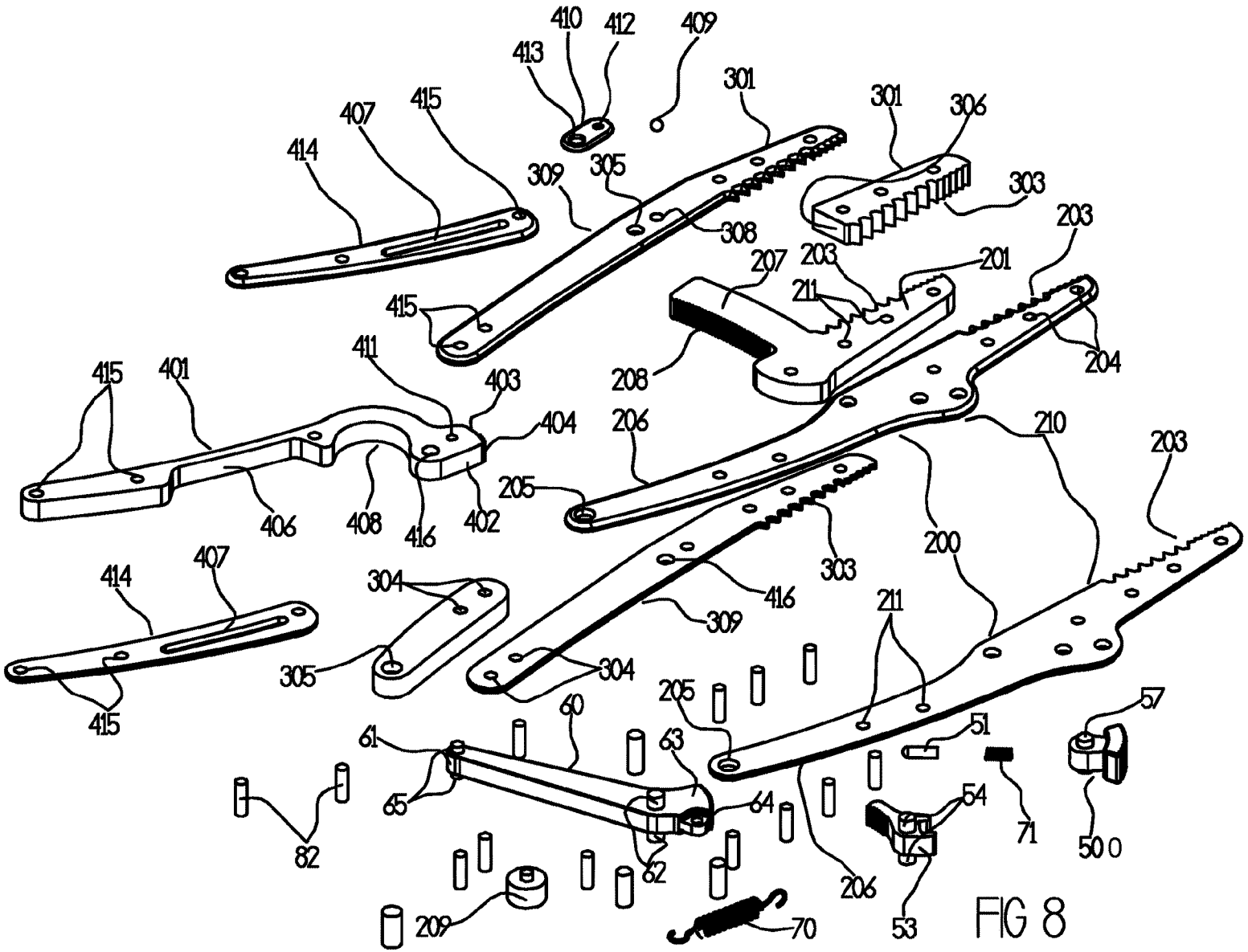
FIG. 8 is a perspective view of the Locking Parallel Pliers, the parts shown dismantled for display purposes.

FIG. 8 illustrates the said Pliers 1, although the composition could consist of mainly cast or forged parts for example, for cost effectiveness the construction shown comprises a semi-laminate like assembly, furthermore the main parts are capable of being stamped or HPM (high pressure moulded) in order to further reduce their manufacturing cost. The various parts are shown dismantled for display purposes.

Referring to FIGS. 1, 2, 5, 9 and 10, the said Parallel Locking Pliers 1 includes, an even further embodiment, comprising a closure sequence, whereas the actual pivotal locations change during the operation of the handle portion 206, 405 clenching. At rest the said arms 200, 300 and 400 with their said jaws 201,301 are urged into their respective open positions by the strut spring 70 and/or the second, third arm springs 72, 73. When the grips 206, 405 are first clenched the second arm 300 with its attached third arm 400 pivots around the pivot pin 80, the first arm bar 207 moving without difficulty within the second jaw slot 307, the adjacent bar smooth portion 212 presenting little resistance to the said second jaw internal contact surface 306 and the third arm smooth cam portion 403 presenting little resistance to the said toothed face 208 of the adjacent first arm bar toothed profile 208 whose saw shaped teeth 208 are in the angle of the least resistance. The strength of the said strut spring 70 or the third arm spring 73, usefully preventing undue third arm 400 to second arm 300 compression during this action, the applied handle grip 206, 405 clenching force C being directed towards the said second jaw 301 being propelled towards the said first jaw 201, till it abuts the said workpiece 90,91 to be operated or clamped, situated between the said opposing jaws 201,301. The said workpiece 90 now lightly grasped between the said first 201 and said second jaws 301 changes the said first and second arm 200, 300 said pivot point 80 to that of the said second arm 300 to third arm 400 pivot point 81. The pivotal strut 60 in the first instance also slightly pivoting as required around the strut pivot pin 62. As the third arm 400 is further robustly clenched C towards the first arm 200 the third arm toothed cam 404 engages the first arm bar toothed profile 208 forcefully closing as required the jaws 201, 301 upon the engaged workpiece 90,91.

Figure 9:
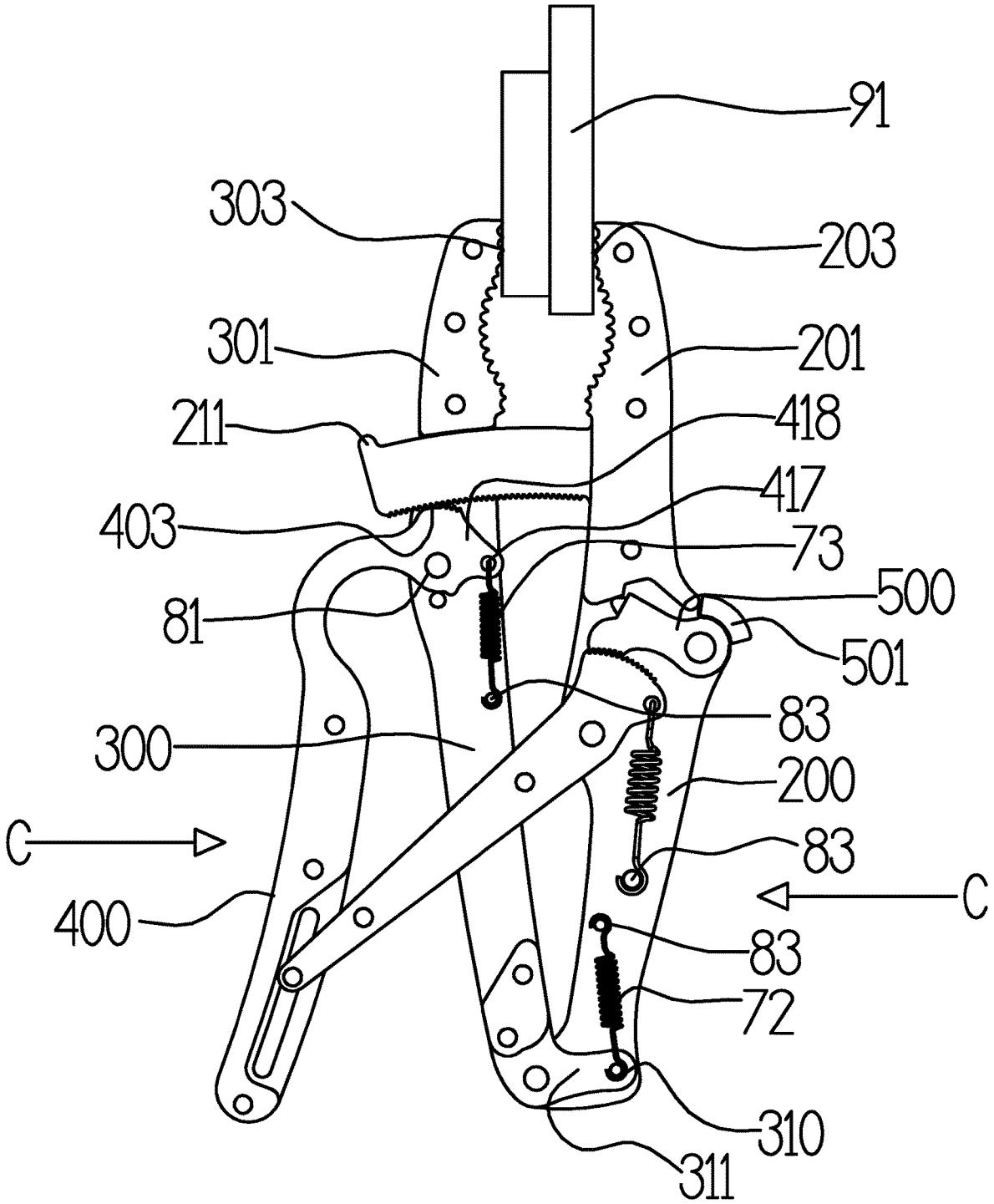
FIG. 9 is a plan view of the Locking Parallel Pliers, resilient portions shown acting upon the second and third handles.

FIG. 9 illustrates a further example of the present invention the said parallel locking pliers 1 wherein the said pliers 1 are shown in the initial clamped position upon clamped metal plates 91. The top first and second arm outer plates 210, 309 removed for display purposes. The strut spring 70 is further removed and substituted by a second arm spring 72 in this example held between a spring end pin 83 mounted within the first arm 200 and the second arm spring lever 311 hole 312, the said spring 72 usefully propelling the first and second arms 200, 300 into their open position when the locking mechanism 50, 53 and 63 is de-activated. A further stronger third arm spring 73 is fitted between the third arm sprung lever portion 418 sprung hole 417 and in this example a spring end pin 83 mounted within the third arm 400. In use the said strong third arm spring 73 substantially prevents the third arm 400 unduly progressing relative to the second arm 300 whilst the second arm 300 jaw element 301 initially closes upon the workpiece 90, 91 now as illustrated lightly held between the said second arm jaw gripping face 303 and the first jaw gripping face 203. Once this first sequence is complete any further clenching force C applied to the first and third arms 200, 400 will result in the second jaw 301 being very robustly propelled towards the first jaw 201 as the third arm 400 pivots around the second to third arm pivot 81 forcefully engaging the third arm toothed cam portion 403 teeth within the first arm bar toothed profile 208 usefully providing the gripping force G required upon the held workpiece, the said gripping force G simply and expediently set by the operators level of clenching force C applied to the handle grips 206, 405. The operator having the further choice of merely gripping the said workpiece 90, 91 or locking the jaws 201, 301 upon the said workpiece 90, 91 according to the operated position of the switch 50.

Figure 10:
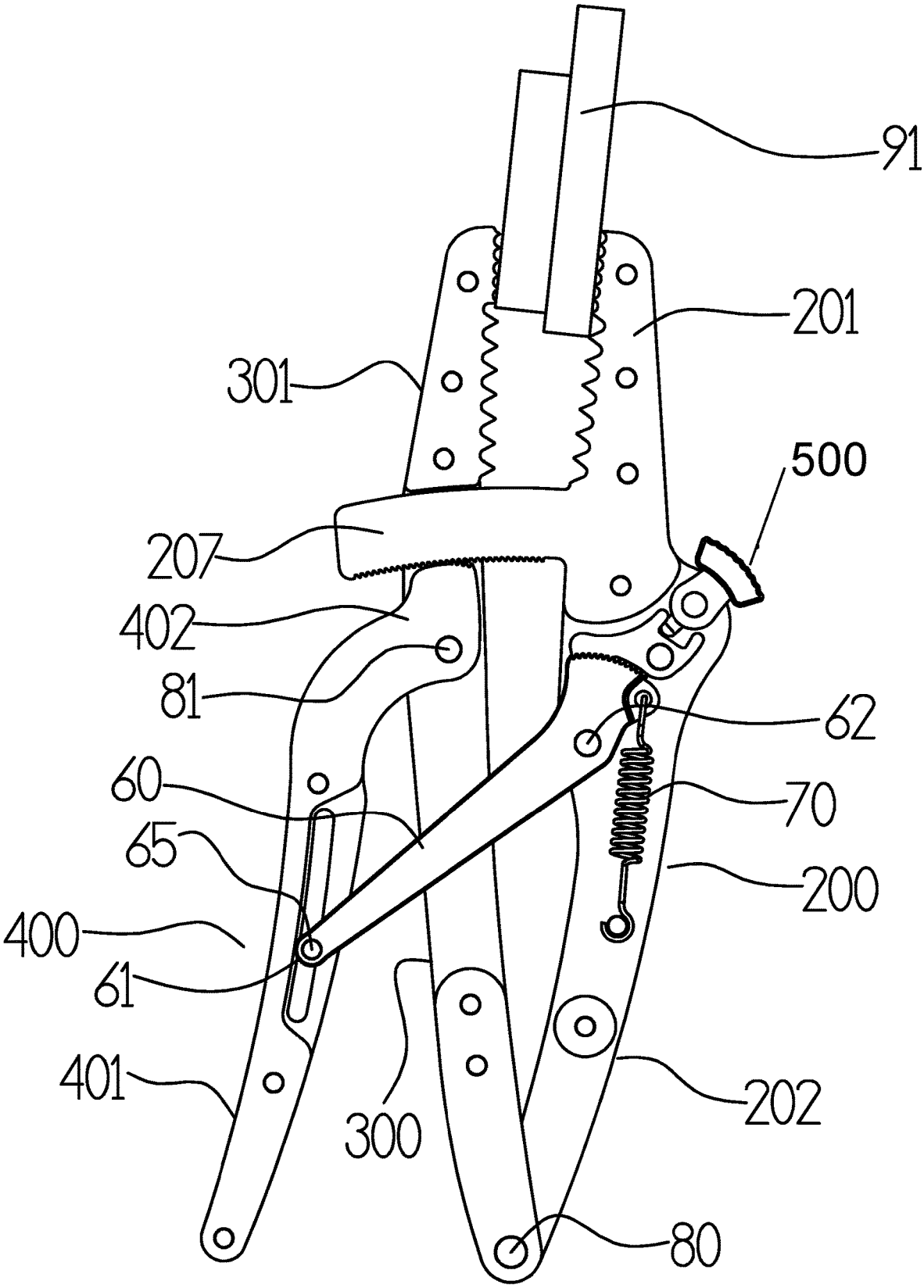
FIG. 10 is a plan view of the Locking Parallel Pliers, with no deliberate resilient portion.

FIG. 10 illustrates a further example of the present invention the said parallel locking pliers 1 wherein any of the said arms 200,300 and 400 do not incorporate any said arm bend promoting portions as illustrated by 408. In all other respects the device 1 is as illustrated in FIGS. 1, 2, 5 and 9

The invention claimed is:

1. Locking parallel pliers comprising:

a first handle, a second handle and a third handle, the second handle being disposed between the first and third handles, wherein the third handle is pivotally attached to the second handle by a first pivot pin with a first extension spring between the said first and the third handles biasing the third handle open from the second handle;

a first jaw element contiguous with a first end of the first handle and a second jaw element contiguous with a first end of the second handle;

a bar extending from said first handle, said bar slidingly received within a channel defined by said second handle and having a surface provided with teeth; and a cam provided at a first end of said third handle, said cam comprising a substantially smooth cam arc portion and a toothed cam arc portion that is contiguous with said smooth cam arc portion, wherein the first and second handles have respective second ends and are pivotally connected by a second pivot pin at at said second ends, wherein a second extension spring is attached between the first and second handles biasing the first and second handles open relative to one another, wherein the first and second extension springs each have a pivotal leverage value, the pivotal leverage value of the second extension spring being less than the pivotal leverage value of the first extension spring in order that closure of the first handle towards the second handle can be initiated whilst movement of the third handle towards the second handle is substantially resisted, wherein said third handle includes a bowed resilient portion within the third handle and a pivotal strut extends between said first and third handles, said pivotal strut having a first end pivotally connected to said first handle and a second end pivotally connected to said third handle via an elongate channel provided in said third handle, wherein said first extension spring is connected to said first end of said pivotal strut, and wherein the arrangement is such that, in use, when a user squeezes the first handle and third handle together the first and second jaw elements can initially close on a workpiece by relative pivotal movement of said first and second handles on said second pivot pin whilst movement of the third handle relative to said second handle is substantially resisted said by said first extension spring and when movement of the second handle is inhibited by said first and second jaws gripping said workpiece, the third can pivot around said first pivot pin against said first extension spring thereby rotating said cam provided on the first end of the third handle so that said smooth cam arc portion is rotated away from said teeth of said bar to bring said toothed cam arc portion into engagement with said teeth.

2. The locking parallel pliers of claim 1, wherein said bowed resilient portion is in the form of a slow curve that arches away from said second handle.

3. The locking parallel pliers of claim 2, wherein said bowed resilient portion subtends an angle from about 40 degrees to about 140 degrees.

4. The locking parallel pliers of claim 3, wherein said third handle has at least one width outside of said bowed resilient portion and said bowed resilient width has a width from about 5% to about 80% thinner than said at least one width outside of said bowed resilient portion.

5. Locking parallel pliers comprising:

a first handle having a first end connected with a first jaw and a second end;

a second handle having a first end connected with a second jaw and a second end pivotally connected by a first pivot pin with said second end of the first handle;

a first biasing member acting between said first and second handles;

a third handle pivotally connected by a second pivot pin to said second handle and arranged such that said second handle is disposed between said first and third handle;

a second biasing member acting between said second and third handles and a third biasing member acting between said first and third handles, wherein said first, second and third biasing members are configured such that said third biasing member provides a relatively greater bias than said first and second biasing members;

an elongate member projecting from said first handle through an opening provided in said second handle and having a side provided with a series of teeth, wherein said third handle comprises a nose portion that engages said teeth and is provided with a relatively smooth portion and a toothed portion; and a locking mechanism for locking said first and second jaws, said locking mechanism comprising a strut pivotally connected with said first handle and having a first end slidingly connected with a groove provided in said third handle and a second end provided with first locking teeth and a switch pivotally connected with said first handle and provided with second locking teeth releasably engageable with said first locking teeth, the arrangement being such that, in use, a user applied force squeezing the first and third handles together causes said first and second handles to close to bring said first and second jaws into engagement with a workpiece disposed between said first and second jaws and at least substantially no movement of said third handle towards said second handle and a resistance to movement of said first jaw towards said second jaw provided by said workpiece engage between said first and second jaws causes said third handle to pivot relative to said second handle moving said relatively smooth portion out of engagement with said series of teeth and engaging said toothed portion with said series of teeth.

6. The locking parallel pliers of claim 5, wherein said first and second locking teeth are saw teeth.

7. The locking parallel pliers of claim 5, wherein said switch is provided with a sliding member mounted in a housing defined in said switch and a biasing member configured to bias said sliding member outwardly of said housing, wherein said sliding member is configured to engage an abutment on said first handle when said first and second locking teeth are engaged, whereby, in use, when said first and second handles are squeezed together said second locking teeth can ratchet over said first locking teeth by sliding movement of said sliding member against said biasing member.

8. Locking parallel pliers comprising:

a first handle having a first end connected with a first jaw and a second end;

a second handle having a first end connected with a second jaw and a second end pivotally connected by a first pivot pin with said second end of the first handle;

a first biasing member acting between said first and second handles;

a third handle pivotally connected by a second pivot pin to said second handle and arranged such that said second handle is disposed between said first and third handle, wherein said third handle comprises an arcuate portion arched in a direction away from said second handle and having a width measured in said direction that is at least substantially in the range 5 to 80% less than the width of said third handle outside of said arcuate portion;

a second biasing member acting between said second and third handles and a third biasing member acting between said first and third handles, wherein said first, second and third biasing members are configured such that said third biasing member provides a relatively greater bias than said first and second biasing members; and an elongate member projecting from said first handle through an opening provided in said second handle and having a side provided with a series of teeth, wherein said third handle comprises a nose portion that engages said teeth and is provided with a relatively smooth portion and a toothed portion, the arrangement being such that, in use, a user applied force squeezing the first and third handles together causes said first and second handles to close to bring said first and second jaws into engagement with a workpiece disposed between said first and second jaws and at least substantially no movement of said third handle towards said second handle and a resistance to movement of said first jaw towards said second jaw provided by said workpiece engage between said first and second jaws causes said third handle to pivot relative to said second handle moving said relatively smooth portion out of engagement with said series of teeth and engaging said toothed portion with said series of teeth.

9. The locking parallel pliers of claim 8, wherein said arcuate portion subtends an angle at least substantially in the range 40 to 140 degrees.

10. The locking parallel pliers of claim 8, further comprising a locking mechanism for locking said first and second jaws, said locking mechanism comprising a strut pivotally connected with said first handle and having a first end slidingly connected with a groove provided in said third handle and a second end provided with first locking teeth and a switch pivotally connected with said first handle and provided with second locking teeth releasably engageable with said first locking teeth, wherein said switch is provided with a sliding member mounted in a housing defined in said switch and a biasing member configured to bias said sliding member outwardly of said housing, wherein said sliding member is configured to engage an abutment on said first handle when said first and second locking teeth are engaged, whereby, in use, when said first and second handles are squeezed together said second locking teeth can ratchet over said first locking teeth by sliding movement of said sliding member against said biasing member.

* * * * *